United States Patent [19]

Pryke

[11] 4,040,260

[45] Aug. 9, 1977

[54] PILE WITH DOWNWARDLY EXTENDING ELONGATED ELEMENTS

[75] Inventor: David Speaight Pryke, Brent Pelham, England

[73] Assignee: Pynford Limited, London, England

[21] Appl. No.: 671,023

[22] Filed: Mar. 26, 1976

[30] Foreign Application Priority Data

| | | |
|---|---|---|
| Mar. 26, 1975 | United Kingdom | 12761/75 |
| July 7, 1975 | United Kingdom | 28575/75 |

[51] Int. Cl.[2] ..... E02D 5/34

[52] U.S. Cl. ..... 61/53.62; 61/53

[58] Field of Search ..... 61/53, 53.62, 53.5, 61/53.52, 53.54, 53.58, 53.68, 56.5, 53.6, 56; 52/155–165

[56] References Cited

U.S. PATENT DOCUMENTS

| | | | |
|---|---|---|---|
| 2,332,990 | 10/1943 | Collins | 61/53 |
| 3,054,268 | 9/1962 | Moller | 61/53.58 X |
| 3,199,301 | 8/1965 | Chitis | 61/56 X |
| 3,332,247 | 7/1967 | Proctor | 61/53 |
| 3,468,131 | 9/1969 | Seidenberg | 61/53.52 X |
| 3,526,069 | 9/1970 | Deike | 61/53.68 X |

FOREIGN PATENT DOCUMENTS

| | | | |
|---|---|---|---|
| 830,028 | 1/1952 | Germany | 61/53.68 |

*Primary Examiner*—Dennis L. Taylor
*Attorney, Agent, or Firm*—Martin P. Hoffman

[57] ABSTRACT

A friction pile has an elongate columnar body which extends at least 1 m. down into the ground and is arranged to carry a structural load at its upper end. A number of rods or other elongate elements, each of smaller cross-sectional area than the body are connected at their upper ends to the pile body and extend in a direction with a downward component into the ground to shed at least a major portion of the structural load into the ground.

11 Claims, 3 Drawing Figures

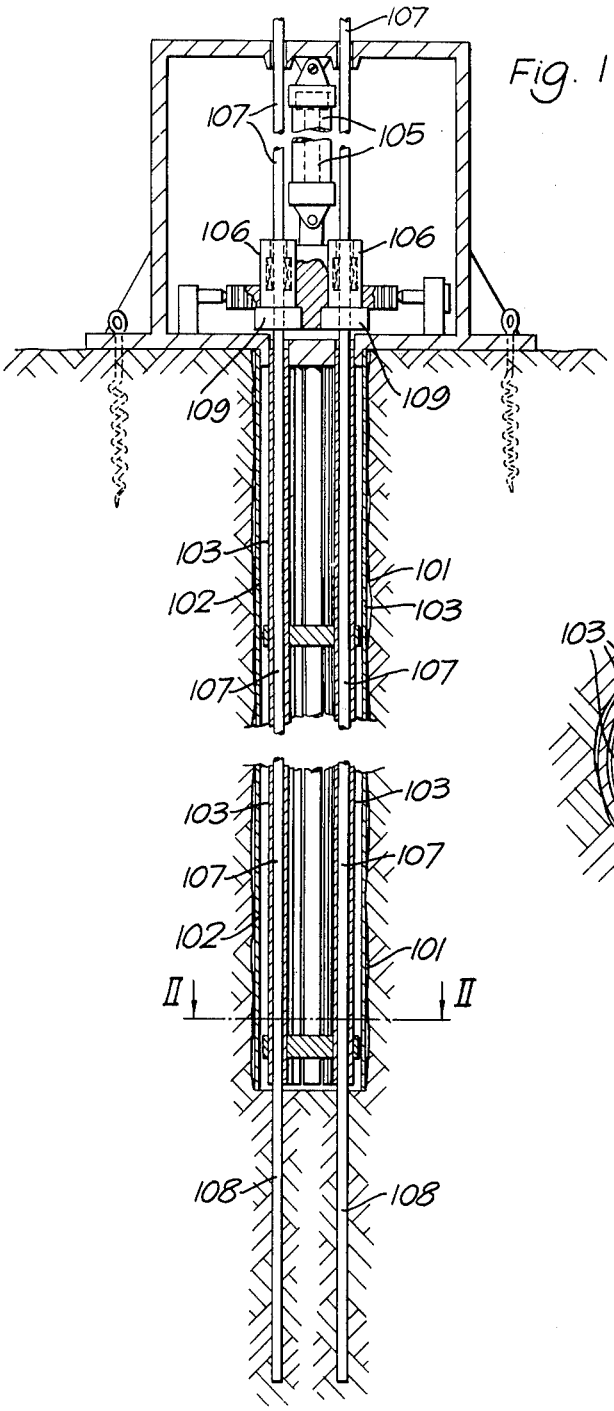
Fig. 1.
Fig. 2.
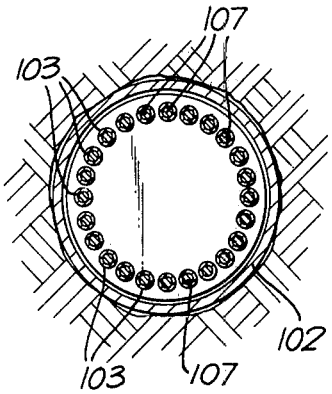

PILE WITH DOWNWARDLY EXTENDING ELONGATED ELEMENTS

The invention relates to friction piles which are provided in the ground for supporting structural loads. Such a pile is usually a solid column of material such as steel or concrete, which is either hammered downwards into the ground by means of a pile driver, or is formed in situ in a hole bored in the ground. In use the pile sheds its load into the ground primarily through skin friction between its outer surface and the surrounding stable earth. The maximum safe load which a pile can support is therefore proportional to its circumference, that is proportional to its diameter, whereas the size and weight of the pile, and the volume of spoil which has to be removed when a pile is formed in situ is proportional to the cross sectional area of the pile, that is proportional to the square of the diameter. As a result conventional piles are generally unwieldy and a great deal of effort and site disturbance is necessary to put them down. It follows that when utilizing conventional friction piles to support foundation beams or slabs or underpinning beams, as few piles as possible are put down and the slab or beam is made correspondingly strong to span between adjacent piles.

In accordance with the present invention a pile comprises an elongate columnar body which extends at least 1 m. downwards into the ground and is arranged to carry a structural load at its upper end and a number of elongate elements, each of smaller cross sectional area than the body, which are connected at their upper ends to the pile body and extend in a direction with a downward component into the ground to shed at least a major portion of the structural load into the ground.

The pile may be formed by forming in the ground a hole generally of the shape and size of the pile body, forcing the elongate members downwardly into the ground through the wall of the hole, and providing in the hole a pile body connected to the upper ends of the elongate members.

The elongate members may be rods of a non corrosive material such as stainless steel, carbon fibre, or a plastics material.

The upper ends of the rods may be embedded within the pile body which comprises an in situ cast material, such as epoxy resin or a cementitious grout, with the optional inclusion of reinforcement or preformed members. Alternatively the upper ends of the rods may be connected to a casing of or forming the pile body.

The aggregate circumferential area of the elongate elements may exceed that of the pile body, whilst the load bearing capacity of the pile will approach the aggregate load bearing capacity of the individual elements, so that the new pile having a given load bearing capacity can be put down through a smaller hole at ground level, as compared to a conventional pile of constant cross section throughout its length. This has the advantage of requiring simpler drilling equipment, less spoil, and less disturbance adjacent for example to a house to be underpinned. In other words the projecting elements significantly increase the effective diameter (or cross sectional dimension in the case of a pile body of non-circular section) of the pile and the increase in effective diameter, and hence increase in safe loading may amount to a factor of eight or more. This reduction in size for a given load bearing capacity makes it economical to put down piles at more closely spaced intervals than previously, enabling foundation slabs or beams, such as underpinning beams, to be made thinner.

The actual load bearing capacity of a pile, the body of which has a given diameter, can be determined as necessary by putting down the appropriate number of elongate elements, taking into account the soil conditions.

The new piles are particularly suitable for use in cohesive soils, such as clay, but the pile may also be useful in coarser grained soils, such as sand. In permeable soils the ground through which the elements penetrate may be strengthened with a grout.

The elements may be forced into the ground individually or in groups using a reaction much less than the full load bearing reaction of the finished pile. This further simplifies the jacking or other equipment necessary to put down the pile.

Although the invention is applicable to piles of any size, a particular advantage is the possibility of using slender piles at closely spaced intervals in foundation construction or stabilization or for use in underpinning load bearing walls. In that case the pile body may have a diameter of up to 150 mm., if the pile is to have a load bearing capacity of say up to 5 tons. The pile may be formed in a hole having a similar diameter although if it is necessary to protect the upper portion of the pile body against lateral movement of surrounding unstable earth, it may be necessary to provide a larger prebored hole and to fill the space around the upper portion of the pile body with a fluent or crushable materal, or leave it as a void. By way of example, the slender pile may have a length in excess of 6 m. with the elongate elements constituting say the lower 2 m. or 3 m. of the pile. The elongate elements may themselves be between 200 mm. and 3 m. long; between 2 mm. and 15 mm. in diameter; and may number from 20 up to several hundred.

The possibility of constructing the pile through a small prebored hole makes it feasible, when underpinning buildings, to insert an inclined pile through a hole bored through the existing wall above or beneath the inner damp-proof course without penetrating the inner face of the wall above floor level but with the axis of the support close to the inner face of this wall, thus minimising eccentric loading of the piles via a new foundation beam to which the tops of the piles are united.

A number of different techniques are possible for driving the individual elongate elements down through the wall of the hole. Elements driven through the bottom of the hole may be driven, for example, by a jacking unit which is inserted down into the prebored hole and takes its reaction from the surrounding ground by spreading a foot or sleeve of the unit into firm engagement with the surrounding round. The unit may then incorporate a reciprocating chuck which is rotatable to different angular positions for the driving in of each element in turn. Alternatively the reciprocating chuck may act above ground level and force the elements down through temporary guide tubes in the hole.

The hole through which the rods are driven is not necessarily prebored. It may be driven by a pilot foot on the lower end of a mandrel. The driving of the hole has the advantage that it acts to consolidate the surrounding earth and hence provide a greater reaction for the rods.

The pile body will normally be grouted solid as a final step. Alternatively, however, the pile body might be a hollow cylinder to which the upper ends of the rods or other elongate elements are attached.

One example of a pile constructed in accordance with the invention is illustrated in the accompanying drawings, in which:

FIG. 1 is a vertical sectional view showing the construction of the pile;

FIG. 2 is a section taken on the line II—II in FIG. 1; and,

Figure 3:
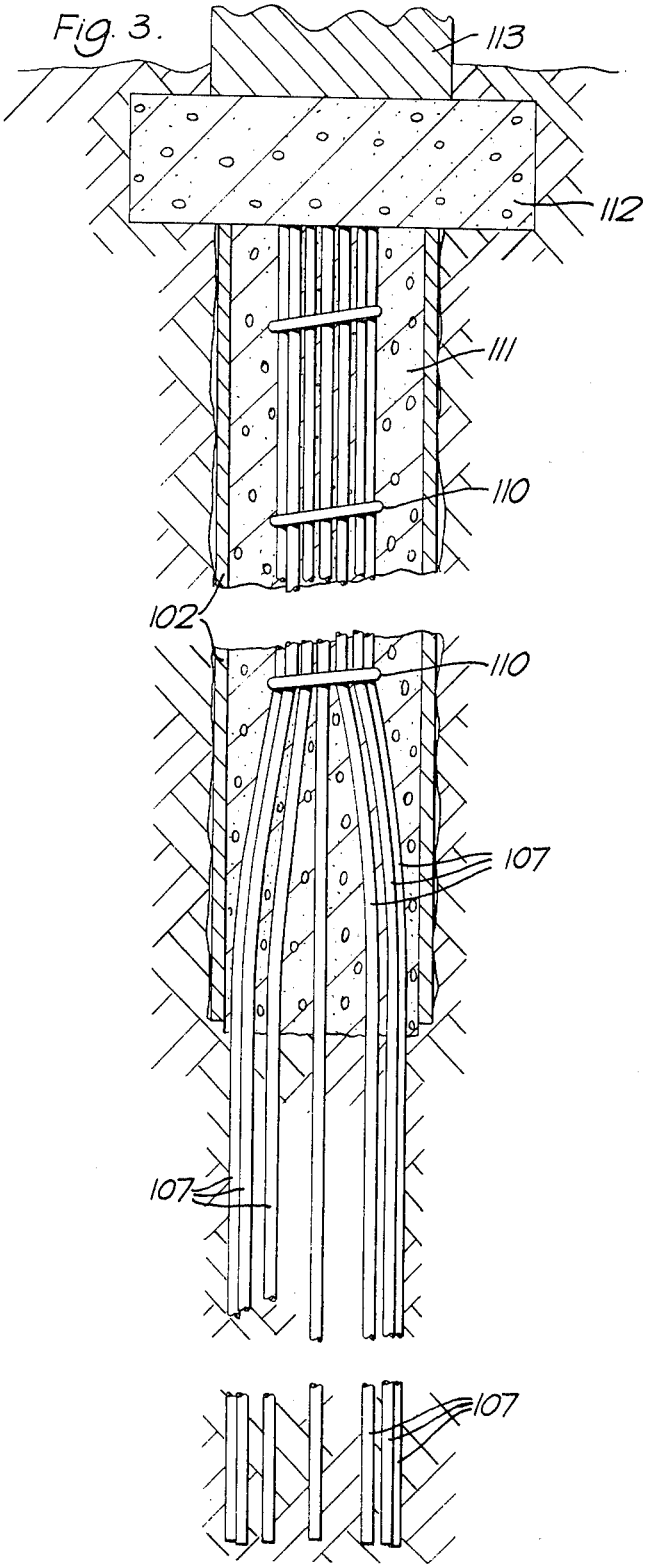
FIG. 3 is a view similar to FIG. 1 showing the pile completed.

The illustrated pile is constructed by first drilling a 150 mm. diameter hole 101 about 3 meters into the ground. The hole is then lined with an expanded polystyrene sleeve 102. A rigid cylindrical array of guide tubes 103 is lowered down the hole and its upper end is secured to a frame 104 of a hydraulic jacking unit which incorporates a double acting ram 105 connected to two spring-loaded collet chucks 106.

The ends of two 10 mm. diameter stainless steel rods 107 are then inserted down through the jacking unit and through two of the guide tubes at diametrically opposite postions. The rods 107 may be individual rods about 7 m. long or they may be fed from a supply on a large diameter drum. The ends 108 of the rods 107 are then forced down into the ground through the bottom of the hole 101 by the reciprocating action of the ram 105 and chucks 106. The rods are forced down until the necessary reaction from stable earth is obtained. This may be pre-calculated and a predetermined length of the rod inserted into the ground, or a rod may be inserted until a predetermined reaction is reached. At this time the upper ends of the rods 107 are cut off by operating shearing devices 109, and the chucks 106 are rotated to a new position to put down another diametrically opposed pair of rods 107.

When all the rods have been put down in the same way, the jacking unit is removed, and the array of guide tube 103 is lifted up out of the hole off the upper ends of the rods 107. The rods may then be drawn together by the threading on and pushing down of loose rings 110. The hole is then grouted up with an epoxy resin, or a cementitious grout to form a solid pile body 111, which is reinforced by the upper ends of the rods 107. The tops of a number of piles may then be united with a common pile cap 112 for supporting a building structure 113.

I claim:

1. A method of forming a pile comprising an elongated columnar body adapted to carry a structural load at its upper end, and a plurality of elongated elements, each of the elongated elements being of smaller cross-sectional area than said body, said elements being connected at their upper ends to said pile body, the method comrpising the steps of:

a. forming a hole in the ground approximating the size and shape of the columnar body of the pile,
b. lowering an array of guide tubes into the hole, the guide tubes being slightly larger in cross-sectional area than the elongated elements,
c. inserting elongated elements into the guide tubes,
d. applying forces to the elongated elements to drive the bottom ends thereof downwardly into the ground through the bottom of the hole,
e. lifting the array of guide tubes out of the hole, and
f. grouting the hole to form a solid pile body which is reinforced by the upper ends of the elongated elements contained therein.

2. The method of claim 1 further including the step of drawing the elements together by pushing rings thereover prior to grouting the hole.

3. The method of claim 1 further including the step of lining the hole with a sleeve prior to lowering the array of guide tubes into the hole.

4. The method of claim 1 further including the step of severing that portion of each of the elongated elements that projects upwardly beyond ground level.

5. The method of claim 1 wherein the elongated elements are inserted into the guide tubes at diametrically opposite positions.

6. The method of claim 1 further including the step of forming a pile cap to unite several piles together.

7. A pile comprising:

a. an elongated columnar body adapted to extend into a hole in the ground,
b. a plurality of elongated elements extending axially within said body,
c. said elongated elements projecting downwardly beyond said columnar body into the ground,
d. ring means encircling said elongated elements at axially spaced intervals for drawing said rods together within the columnar body, and
e. said columnar body being formed of an in-situ cast material that has the upper ends of the elongated elements and the ring means embedded therewithin.

8. A pile as defined in claim 7 further including an annular sheath surrounding said columnar body.

9. A pile comprising:

a. an elongated columnar body adapted to extend into a pre-bored hole in the ground,
b. said columnar body having a maximum diameter of 150 mm.,
c. a plurality of elongated elements extending axially within said body,
d. said elongated elements projecting downwardly beyond said columnar body into the ground,
e. said columnar body being formed of an in-situ cast material that has the upper ends of the elongated elements embedded therewithin, and
f. an annular void defined between said columnar body and the ground surrounding same.

10. A pile as defined in claim 9 wherein the annular void is filled by a fluent or crushable material.

11. A pile as defined in claim 9 wherein ring means encircle said elongated elements at axially spaced intervals for drawing said rods together within the columnar body.

* * * * *